United States Patent [19]

Scheinecker

[11] Patent Number: 4,516,623

[45] Date of Patent: May 14, 1985

[54] CONTINUOUS CASTING PLANT

[75] Inventor: Alois Scheinecker, Linz, Austria

[73] Assignee: Voest-Alpine Aktiengesellschaft, Linz, Austria

[21] Appl. No.: 419,282

[22] Filed: Sep. 17, 1982

[30] Foreign Application Priority Data

Sep. 17, 1981 [AT] Austria ..... 4018/81

[51] Int. Cl.[3] ..... B22D 11/04

[52] U.S. Cl. ..... 164/416; 164/418

[58] Field of Search ..... 164/418, 416, 137, 459, 164/478, 339

[56] References Cited

U.S. PATENT DOCUMENTS 4,129,173 12/1978 Scheurecker et al. ..... 164/418 X
4,129,174 12/1978 Holleis et al. .
4,210,197 6/1980 Hargassner et al. ..... 164/416
4,323,107 4/1982 Pietryka ..... 164/416

FOREIGN PATENT DOCUMENTS 2821383 11/1979 Fed. Rep. of Germany .

*Primary Examiner*—Nicholas P. Godici
*Attorney, Agent, or Firm*—Brumbaugh, Graves, Donohue & Raymond

[57] ABSTRACT

In a continuous casting plant including a reciprocating lifting table, the mould is accommodated by this lifting table. Following upon the mould, a strand guide section, in particular designed as a bending device, is arranged. In order to permanently ensure the correct adjustment of the mould relative to the strand guide section following upon the mould, with a quick exchange of the mould being still feasible, the mould is guided on the strand guide section following thereupon and the lifting table is aligned and guided via the mould.

4 Claims, 3 Drawing Figures

1
2
3
4
5
6
12
13
14
18
32
II
III

CONTINUOUS CASTING PLANT

BACKGROUND OF THE INVENTION

The invention relates to a continuous casting plant comprising a reciprocating lifting table accommodating the mould, and a strand guide section, in particular designed as a bending arrangement, following upon the mould.

In continuous casting plants the mould usually is detachably fastened to the reciprocating lifting table, and adjustable in its position relative to the lifting table, in order to be able to align the axis of the mould with the axis of the strand guide section following upon the mould, if necessary (cf., U.S. Pat. No. 4,129,174). To adjust the mould on the lifting table, adjustment means are provided by which the position of the mould relative to the lifting table and the position of the mould relative to the bending zone have to be corrected frequently. This calls for manipulations within the plant and thus a standstill of the plant during this period of time.

The invention aims at avoiding these disadvantages and difficulties, and has as its object to provide a plant of the initially defined kind in which the adjustment of the mould relative to the strand guide section following upon the mould is facilitated and in which no further checks or adjustments are required thereafter, the mould being removable and installable quickly and simply.

SUMMARY OF THE INVENTION

This object is achieved according to the invention in that the mould is guided on the strand guide section following upon the mould and that the lifting table is aligned and guided via the mould.

It is known from German Offenlegungsschrift No. 28 21 383 to guide a mould on rollers mounted on a strand guide section following upon the mould, with a lifting table being renounced, yet this construction has a number of disadvantages. Thus, the reciprocation drive, i.e., the pivot lever of the reciprocation drive, has to be fastened directly to the mould, and furthermore, tube conduits for supplying cooling water to the mould have to be connected directly to the mould. In the event of a mould exchange this constitutes an impediment, since one is forced to detach the mould from the reciprocation drive in the narrow space laterally of the mould and to dismount the water connections from the mould. These tasks are very time consuming because of the narrow space conditions, and, therefore, a "quick exchange" of the mould is not possible with this known plant. It is, furthermore, known to commonly remove the mould and the reciprocation means, which again requires more money and time.

Suitably, in accordance with the present invention at least one guiding sword is arranged on the mould, which is guided on rollers journaled on the strand guide section, or vice versa, the guiding sword or the rollers being adjustable for adjusting the mould relative to the strand guide section.

In order to ensure an upright position of the lifting table after a removal of the mould, the lifting table, according to a preferred embodiment, is hinged to the reciprocation drive so as to be pivotable in a manner delimited by stops.

BRIEF DESCRIPTION OF THE DRAWINGS

The invention will now be explained in more detail with reference to the accompanying drawings, wherein.

DESCRIPTION OF EXEMPLARY EMBODIMENT

Figure 1:
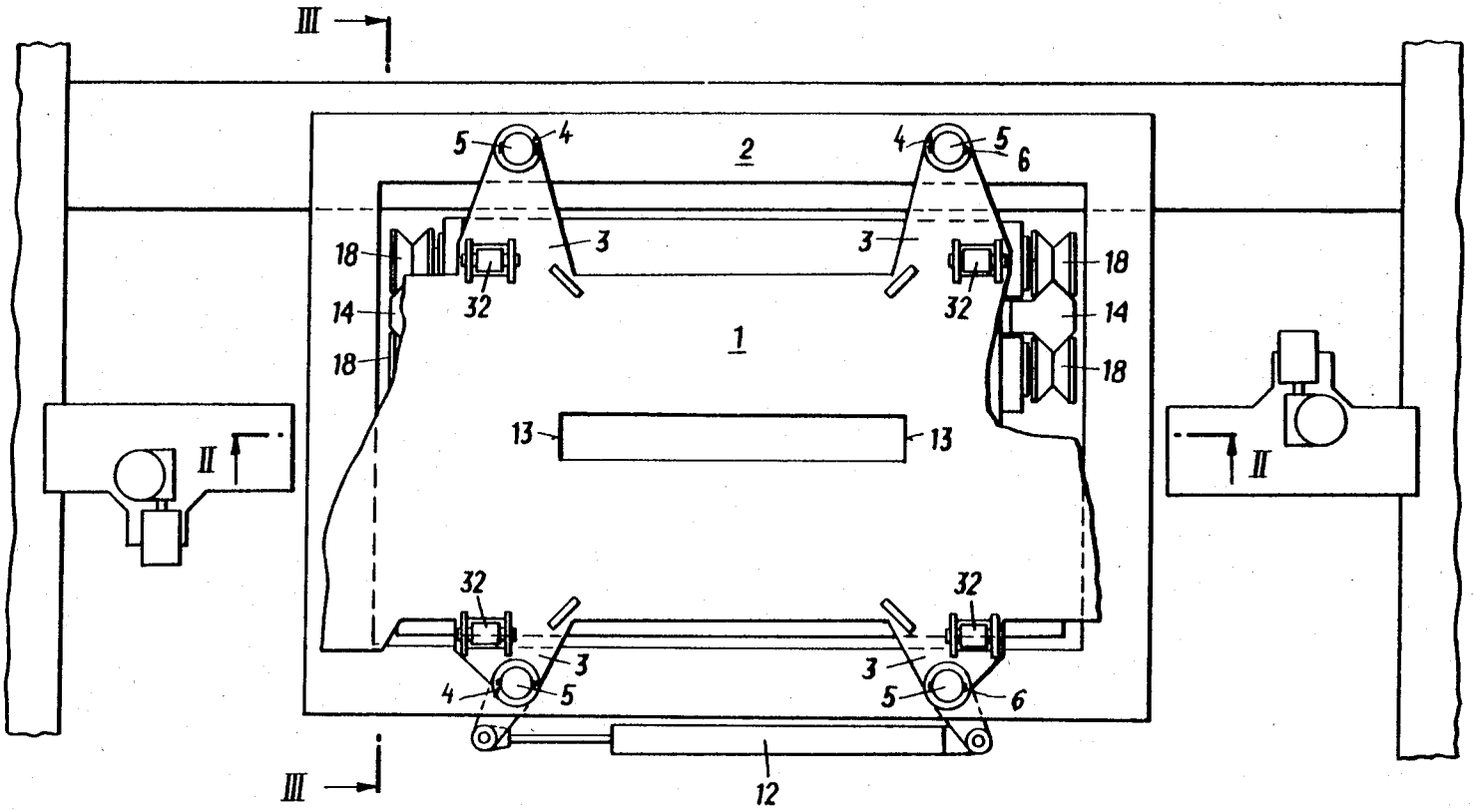
FIG. 1 is a top view of a mould installed in the continuous casting plant in accordance with the present invention.
Figure 2:
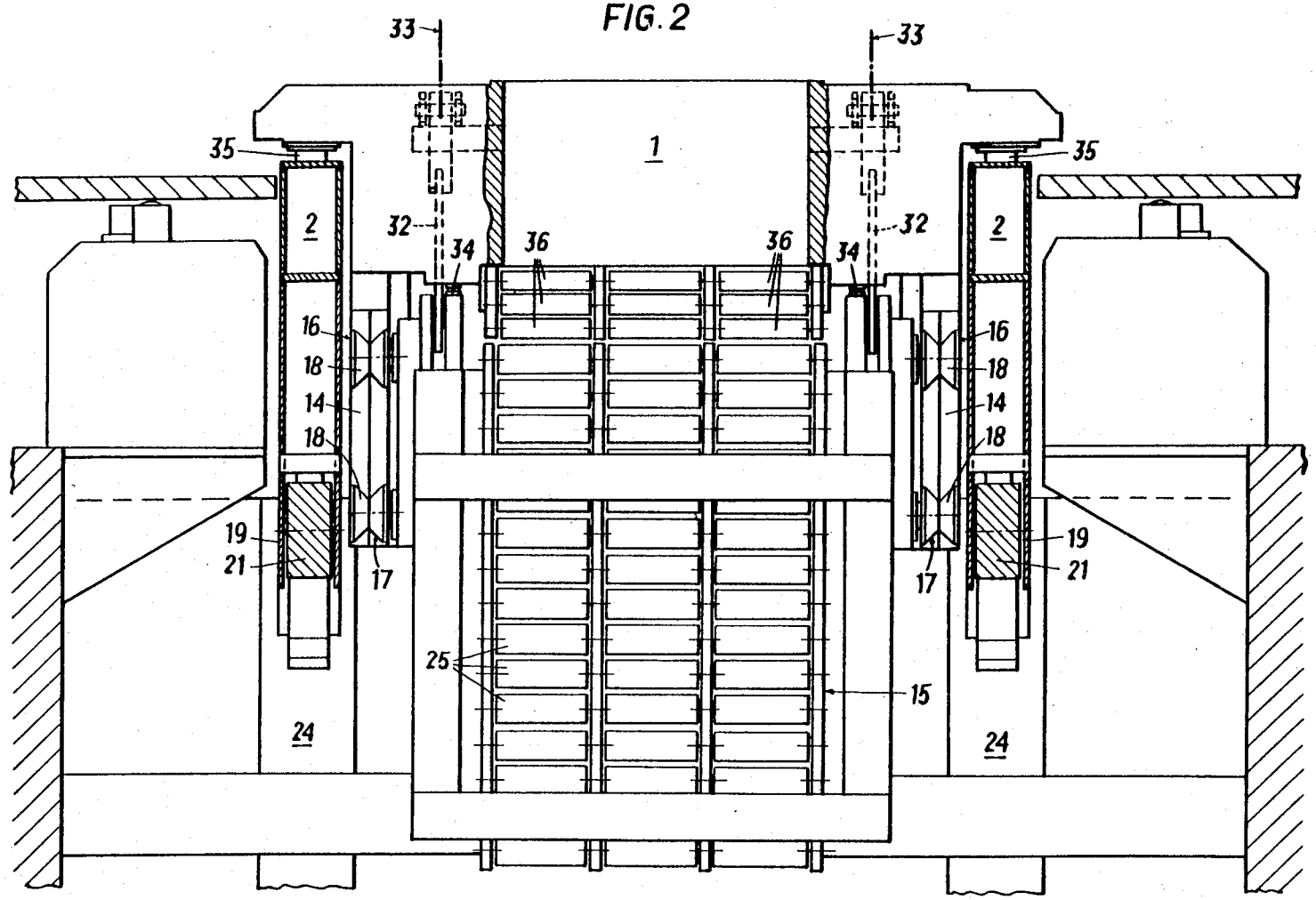
FIG. 2 is a section taken along the line II—II of FIG. 1.
Figure 3:
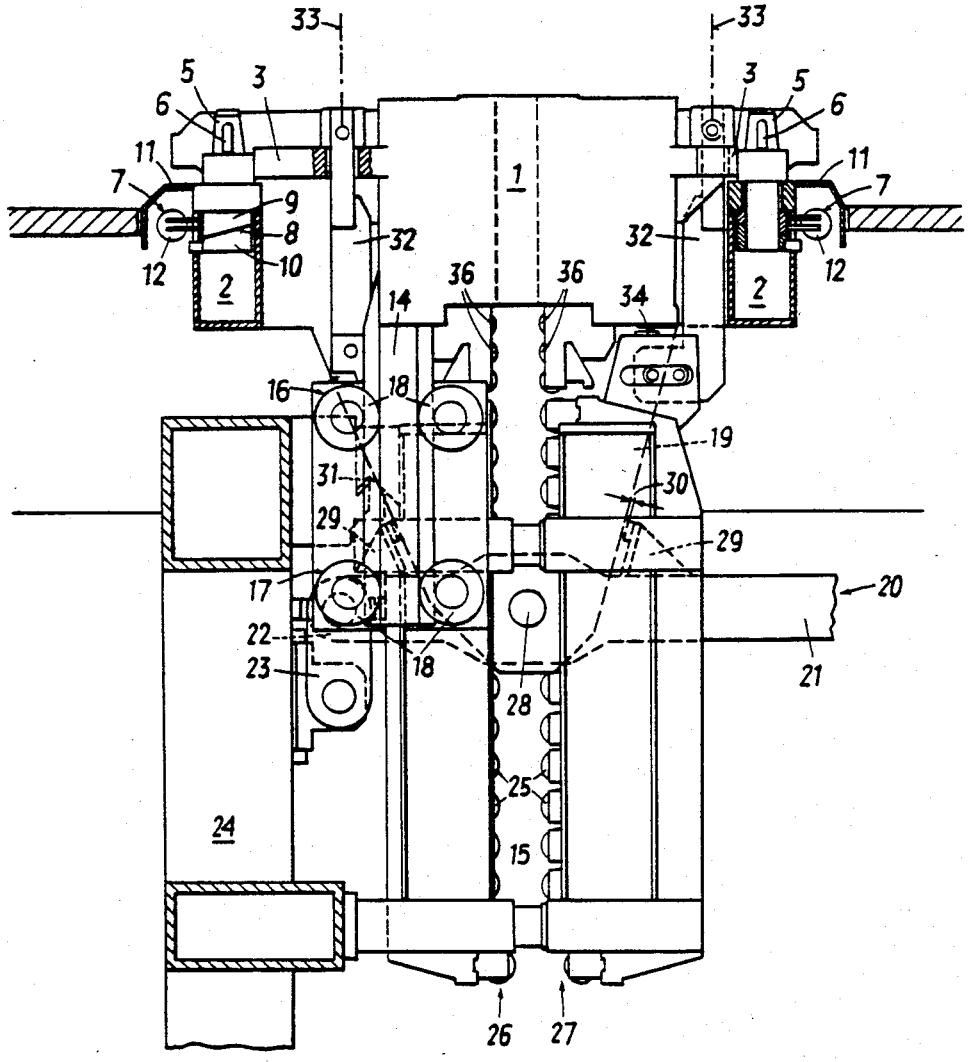
FIG. 3 is a section taken along the line III—III of FIG. 1.

A mould 1, which is designed as a plate mould, is inserted in a frame-shaped lifting table 2 and suppoted relative to this lifting table by means of consoles 3 fastened to it. These consoles, on their ends, comprise bores 4, which are penetrated by pins 5 mounted to the lifting table. Insert pieces 6 extending over the consoles 3 transversely through the pins 5 serve to fix the mould 1 on the lifting table 2. Each of the pins 5, with its insert piece 6, is clampable against the console 3 by a quick-detachment means 7 (FIG. 3). Each quick-detachment means 7 for this purpose comprises two bushes 9, 10 contacting each other via helical surfaces 8, one of which bushes 10 is rigidly mounted to the pin 5, and the bush 9 lying between this bush 10 and the upper cover plate 11 of the lifting table 2 being pivotable by means of a pressure medium cylinder 12.

The mould, on each of its end sides 13, comprises a guiding sword 14 extending vertically downwardly in the direction towards the bending zone 15 following upon the mould. On the bending zone 15, two roller pairs 16, 17 are journaled for each of the guiding swords 14, between whose rollers 18 the guiding sword 14 is guided. These guiding rollers 18 preferably are adjustable (for instance by eccenter axles), so that the position of the guiding sword 14 and thus the position of the mould 1 relative to the bending zone 15 are adjustable during the assemblage or maintenance of the plant. The lifting table 2 comprises side cheeks 19 located laterally of the end sides 13 of the mould 1 and extending vertically downwardly, by which side cheeks it is hinged to the reciprocation drive 20. To reciprocate, a vertically upwardly and downwardly oscillating lever 21 is set in reciprocating motion by means of a separate drive (not illustrated in detail). On one end 22 the lever 21 is hinged to the stationary supporting structure 24 by means of an articulation bracket 23, so that it is able to align in the horizontal direction in dependence on the position of the lifting table 2, transversely through the strand guideways 26, 27 formed by the rollers 25 of the bending zone 15. The alignment and guidance of the lifting table 2 is effected via the guiding rollers 18 mounted to the bending zone 15, the guiding swords 14 guided on these rollers 18, and the mould 1.

In order to ensure an upright position of the lifting table 2 with the mould 1 removed—if the mould 1 is removed, the guidance of the lifting table 2 via the guiding swords 14 does not take place—the lever 21 of the reciprocation drive 20 comprises two consoles 29 that prevent tilting of the lifting table 2 about its articulation axis 28 on this lever 21. These consoles 29, however, comprise a lateral play 30 in respect of the central position of the lifting table 2 (which is assumed if the mould 1 is installed). The lifting table 2 thus is pivotable relative to these consoles 29 in a manner limited by a slight angle.

The bending zone 15 is mounted to the stationary supporting structure 24 by means of a hook-like suspension 31. In the embodiment illustrated, the bending zone 15 comprises lugs 32 for a crane suspension 33, penetrating through the lifting table laterally of the mould 1. The crane suspension 33, which is illustrated in dot-and-dash lines in the Figures, can be suspended into these lugs 32 so that the mould 1, which is supported on bearing surfaces 34 of the bending zone as the bending zone 15 is lifted, is removable commonly with the bending zone 15 after detachment of the quick-detachment means 7 and removal of the insert pieces 6. It is, however, also possible to suspend the crane suspension 33 directly into the mould and to remove the mould 1 without removing the bending zone 15 along with it.

When inserting the mould 1 into the plant, the lifting table is aligned relative to the mould in the horizontal direction by the consoles 3 coming to lie on the upper side of the lifting table 2. The mould 1 itself simultaneously is aligned transversely to the strand guideways 26, 27 by threading the guiding swords 14 in between the rollers of the roller pairs 16, 17, whereupon the mould is fixed on the lifting table 2 by means of the quick-detachment means 7. The water connections 35 preferably are designed in the customary manner as plug connections (e.g., according to Austrian patent No. 338,449 or to U.S. Pat. No. 3,610,322) between the mould and the lifting table, which seal automatically on account of elastically compressible seals as the mould is placed on the lifting table, so that no manipulations whatsoever are to be carried out at the water connections during an exchange of the mould.

After an adjustment of the guiding rollers 18 has once been effected, which may take place, for instance, in the shop or on a bending-zone repair stand, a check of the position of the mould 1 relative to the bending zone 15 is no longer necessary. The foot rollers 36 mounted on the lower side of the mould always assume the correct position relative to the strand guideways 26, 27 formed by the rollers 25 of the bending zone 15, even after several removals and installations of the mould 1.

The invention is not limited to the embodiment illustrated in the drawings, but may be modified in various aspects. It is, for instance, possible to mount the guiding swords to the bending zone 15 and the guiding rollers to the mould 1. It is also possible to journal the guiding rollers on a projection of the bending zone or of the mould and to guide the second part, i.e. the mould or the bending zone, between these rollers by means of rails arranged laterally on it.

What I claim is:

1. In a continuous casting plant including a mould, a reciprocating lifting table accommodating said mould, and a strand guide section following upon said mould, in particular designed as a bending means, the improvement comprising at least one vertically oriented guiding sword arranged on one of said mould and said strand guide section and roller means, including pairs of rollers, for cooperating with said guiding sword arranged on the other of said mould and said strand guide, said guiding sword being inserted between the rollers of said roller means to adjust the position of said mould relative to said strand guide section, and means for aligning said lifting table relative to said mould and means for fastening said mould on said lifting table.

2. A continuous casting plant as set forth in claim 1, wherein said guiding sword is arranged on said mould and said roller means are arranged on said strand guide section.

3. A continuous casting plant as set forth in claim 1, wherein said guiding sword is arranged on said strand guide section and said roller means are arranged in said mould.

4. A continuous casting plant as set forth in any of claims 1, 2 or 3, further comprising means for hinging said lifting table to a reciprocation drive which is adapted to pivot said lifting table, and stops for limiting the pivoting movement of said lifting table.

* * * * *